US008321980B2

(12) United States Patent
Maloney

(10) Patent No.: US 8,321,980 B2
(45) Date of Patent: Dec. 4, 2012

(54) FLEXIBLE SYSTEM FOR SURROUNDING A PERIMETER AND COVERING A TOP SURFACE OF A MATTRESS

(75) Inventor: Jeremy Maloney, Belle Isle, FL (US)

(73) Assignee: The Incredibeds LLC, Belle Isle, FL (US)

( * ) Notice: Subject to any disclaimer, the term of this patent is extended or adjusted under 35 U.S.C. 154(b) by 263 days.

(21) Appl. No.: 12/782,028

(22) Filed: May 18, 2010

(65) Prior Publication Data

US 2010/0223726 A1 Sep. 9, 2010

Related U.S. Application Data

(63) Continuation-in-part of application No. 12/392,362, filed on Feb. 25, 2009, now Pat. No. 7,743,442.

(60) Provisional application No. 61/031,044, filed on Feb. 25, 2008.

(51) Int. Cl.
*A47C 21/08* (2006.01)
*A63H 3/00* (2006.01)

(52) U.S. Cl. ..... 5/655; 5/732; 5/739; 5/424; 5/907

(58) Field of Classification Search ..... 5/732, 739, 5/678, 680, 655, 424, 425, 427, 907, 945, 5/946; 446/72, 73
See application file for complete search history.

(56) References Cited

U.S. PATENT DOCUMENTS

| | | | | |
|---|---|---|---|---|
| 4,765,006 | A * | 8/1988 | Jackson et al. | 5/658 |
| 4,800,600 | A | 1/1989 | Baum | |
| 4,873,734 | A * | 10/1989 | Pollard | 5/425 |
| 5,103,514 | A * | 4/1992 | Leach | 5/417 |
| 5,455,973 | A * | 10/1995 | Brumfield et al. | 5/424 |
| 6,256,965 | B1 | 7/2001 | Sheridan | |
| 6,578,214 | B2 | 6/2003 | Peftoulidis | |
| 6,757,923 | B2 | 7/2004 | Sopher et al. | |
| 6,848,130 | B1 * | 2/2005 | Wilson | 5/425 |
| 7,086,101 | B2 * | 8/2006 | Welch et al. | 5/428 |
| 7,107,635 | B2 * | 9/2006 | Henry et al. | 5/424 |
| 7,546,648 | B2 * | 6/2009 | Steffes | 5/400 |
| 7,743,442 | B2 * | 6/2010 | Maloney et al. | 5/655 |
| 7,996,937 | B2 * | 8/2011 | Walter et al. | 5/485 |

* cited by examiner

*Primary Examiner* — Michael Trettel
(74) *Attorney, Agent, or Firm* — Robert L. Wolter, Esq.; Cian G. O'Brien, Esq.; Beusse Wolter Sanks Mora & Maire, P.A.

(57) ABSTRACT

A flexible system is provided for surrounding a perimeter and covering a top surface of a mattress. The flexible system supports one or more appendage(s) of a character. The flexible system includes a textile or fabric frame for covering portions of a head side, a foot side and intermediate sides of the mattress. The textile or fabric frame forms an opening around a portion of a top surface of the mattress, where the opening has an inner peripheral edge. The flexible system further includes a cover sheet positioned over the top surface, and having an outer peripheral edge that is removably attached to the inner peripheral edge of the opening of the frame. The appendage(s) of the character are supported on the textile or fabric frame at one or more of the head side, the foot side and the intermediate sides of the mattress.

15 Claims, 11 Drawing Sheets

FLEXIBLE SYSTEM FOR SURROUNDING A PERIMETER AND COVERING A TOP SURFACE OF A MATTRESS

CROSS-REFERENCE TO RELATED APPLICATIONS

This application is a continuation-in-part of U.S. application Ser. No. 12/392,362 filed on Feb. 25, 2009, now U.S. Pat. No. 7,743,442, which in-turn, claims the benefit of U.S. Provisional Application No. 61/031,044 filed Feb. 25, 2008, both of which are incorporated herein by reference in their entirety.

FIELD OF THE INVENTION

This invention relates to a system for surrounding a perimeter of and covering a top surface of a mattress and, more particularly, to a system including a textile or fabric frame for covering each side of the mattress, while supporting one or more appendage(s) of an animate character at one or more side(s) of the mattress.

BACKGROUND OF THE INVENTION

Several conventional systems have been developed, which involve a frame or a sleeping arrangement, such as those discussed below. U.S. Pat. No. 4,800,600 to Baum discloses a fancifully-shaped crib bumper having stuffed legs serving in the traditional role of a crib bumper, as well as stuffed arms that provide added protection higher up on the side of a crib. The tubular arms and legs of the novel crib bumper are stuffed by using rolled fiberfill batting, which is placed in an insertion device that may be either preformed in a tubular shape or may comprise a flexible sheet material that is rolled around the rolled fiberfill batting. The use of the insertion device permits the rolled fiberfill batting to be inserted into a crib bumper leg or arm in a simple, easy manner, and is then removed, leaving the fiberfill batting in place. The fiberfill batting is then securely attached to the outer casing of the crib bumper by stitching.

U.S. Pat. No. 6,256,965 to Sheridan discloses a method for the design and fabrication to reproduce a preselected subject matter such as a wild animal in a material comfort object incorporating a cavity that may be enhanced into an enclave by incorporating preselected portions of the subject matter such as a head or legs to add a surround to the cavity, giving preference to reproducing areas of the subject matter with plush material which resembles the color and texture of the subject matter while maintaining easy access to the cavity thereby presenting an exposed surface or comfort panel that is soft, warm and inviting to the user of the object. A sound reproduction device may be added to the object to provide preselected sounds; a child safe pocket may be formed in the object to hold the sound reproduction device.

U.S. Pat. No. 6,578,214 to Peftoulidis discloses various sport-shaped bed designs consisting of a frame, mattress, motion sensors, a rechargeable battery cell and a dimmer night light. The designs have shapes such as a football, baseball, soccer, basketball, and other sport shapes. The bed also comprises storage drawers located in various positions according to the design. Each bed contains battery-operated motion sensors which trigger a night dimmer light. When the sensor indicates a child has laid down in the bed, the dimmer responds to the signal and the light goes on. Within a short period of time, the light slowly dims until it is fully out. If the child should sit up, the sensor will react and the light will go on. The mattress fits down inside a recess in the frame and the headboard.

The conventional systems discussed above have several shortcomings. Although Baum discloses a crib bumper, the bumper is limited to being integrated within the crib frame. Although Sheridan discloses a cavity which is sized to receive the user, the cavity is not sized to receive a mattress or a boxspring, and the frame is limited to a one-piece arrangement. Although Peftoulidis discloses a frame configured to receive a mattress, the frame is expressly limited to a sport-shaped design.

Thus, it would be advantageous to provide a system for surrounding a perimeter of a mattress, which addresses the above shortcomings of conventional bed frames or sleeping arrangements.

BRIEF DESCRIPTION OF THE INVENTION

One embodiment of the present invention provides a flexible system for surrounding a perimeter and covering a top surface of a mattress. The flexible system supports one or more appendage(s) of a character. The mattress has four sides including a head side, a foot side and intermediate parallel sides extending between the head and foot sides. The flexible system includes a textile or fabric frame for covering portions of the head side, the foot side and the intermediate sides of the mattress. The textile or fabric frame forms an opening to receive a top surface of the mattress, where the opening has an inner peripheral edge. The flexible system further includes a cover sheet positioned over the top surface of the mattress, and having an outer peripheral edge that is removably attached to the inner peripheral edge of the opening of the frame. The one or more of the appendage(s) of the character are supported on the textile or fabric frame at one or more of the head side, the foot side and the intermediate sides of the mattress.

Another embodiment of the present invention provides a cover sheet to be positioned over a top surface of a mattress. The cover sheet includes a pair of sleeves to respectively extend along a pair of opposing sides of the cover sheet. The cover sheet further includes a pair of bumpers to be respectively secured within the pair of sleeves. The bumpers extend from the top surface of the mattress by a predetermined vertical height. The cover sheet is formed from a fabric material, covers the top surface of the matters and is secured to the mattress.

Another embodiment of the present invention provides a flexible system for surrounding a perimeter and covering a top surface of a mattress. The flexible system supports one or more appendage(s) of a character. The mattress has four sides including a head side, a foot side and intermediate parallel sides extending between the head and foot sides. The flexible system includes a textile or fabric frame for forming an opening to receive a top surface of the mattress, where the opening has an inner peripheral edge. The flexible system further includes a cover sheet positioned over the top surface of the mattress, the cover sheet having an outer peripheral edge that is removably attached to the inner peripheral edge of the opening of the frame. The one or more of the appendage(s) of the character are supported on the textile or fabric frame at one or more of the head side, the foot side or the intermediate sides of the mattress.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
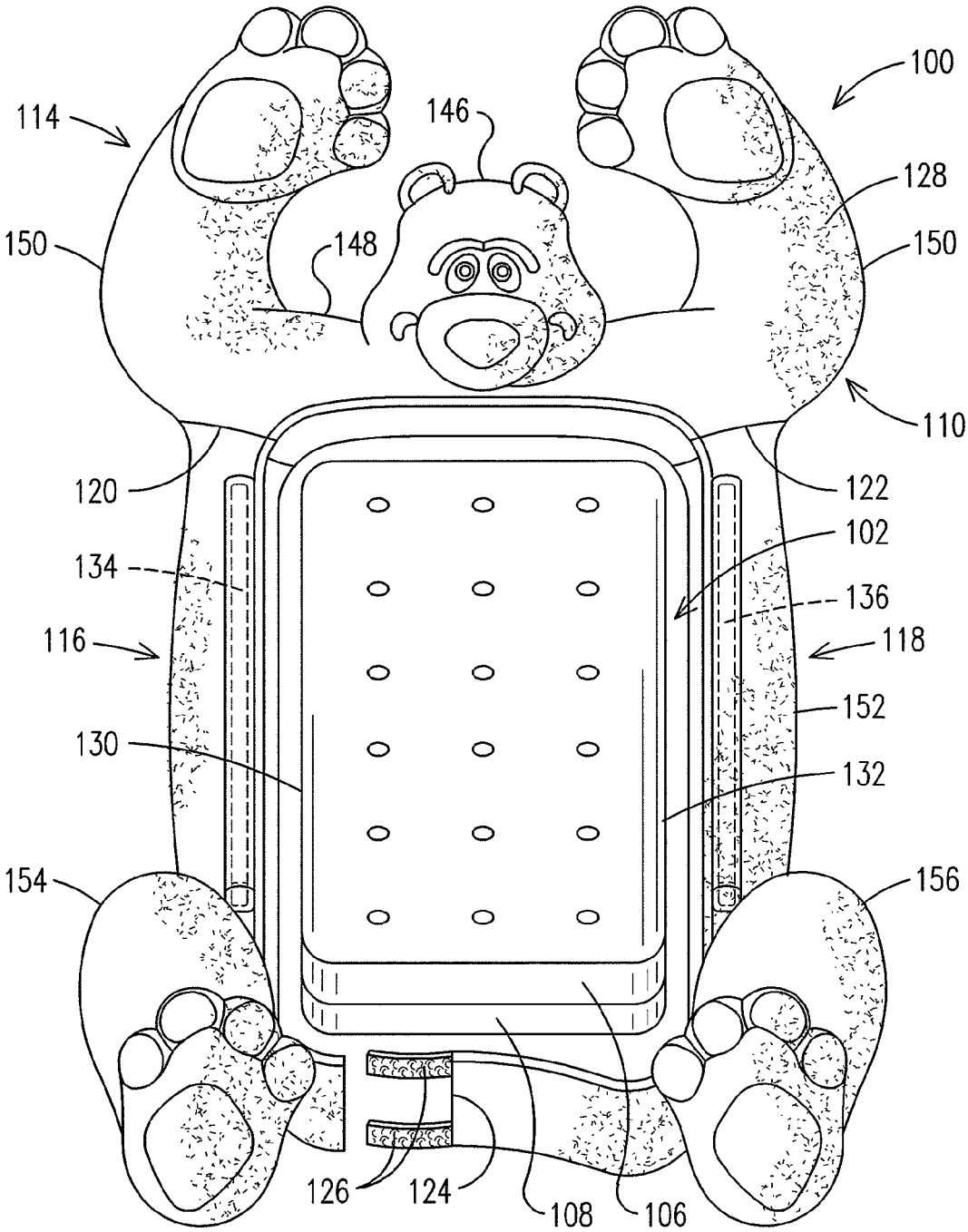
FIG. 1 depicts a top exploded view of an exemplary embodiment of a system for enhancing the safety of a sleeping arrangement for a child on a bed in accordance with the present invention.

Reference will now be made in detail to the embodiments consistent with the invention, examples of which are illustrated in the accompanying drawings. Wherever possible, the same reference numerals used throughout the drawings refer to the same or like parts.

FIG. 1 illustrates an exemplary embodiment of a system 100 to enhance the safety of a sleeping arrangement for a child on a bed 102. The bed 102 includes a mattress 106 and a boxspring 108 (FIG. 3), however the bed may just include the mattress, without the boxspring. The mattress and boxspring may be any one of a single, twin, double, queen or king size mattress/boxspring, and the frame 110 would be correspondingly sized to accommodate the size of the mattress/boxspring. Additionally, the frame 110 may be sized to accommodate a crib mattress/boxspring and, thus, the bed 102 and frame 110 may be utilized as a "transition bed" for toddlers and children as they transition from a crib to a full-sized bed. Additionally, as discussed below, in an exemplary embodiment of the present invention, the frame 110 rests on a floor 176 of a room (FIG. 4) and, thus, the bed 102 is inherently positioned low to the ground, to enhance safety, as a toddler/child transitions from a crib to a full-sized bed.

As illustrated in the exemplary embodiment of FIG. 1, the system 100 includes a frame 110 which encloses a perimeter of the mattress 106 and the boxspring 108. As illustrated in FIG. 1, the frame 110 takes the form of an animate object, such as a bear, and the frame 110 has an outer surface 128 which is formed from a plush material, such as a plush material which conforms to ASTM (American Society for Testing and Materials) standards, for example. However, the frame 110 may take the form of an inanimate object, such as a toy train, for example. Thus, although the embodiments of the present invention discussed below refer to an exemplary embodiment of a frame taking the form of an animate object, such as a bear, the frame may take the form of any animate or inanimate object, provided that it adequately enhances the safety of the sleeping arrangement, as described below. In an exemplary embodiment, the plush material which forms the outer surface of the frame 110 is washable, such that the exterior of the frame may be easily removed and/or cleaned, such as in a standard washing machine, for example.

The frame 110 includes a plurality of sections 114,116, 118, which are removably attached to one another at respective junctures 120,122,124 with hook and loop fasteners 126, such as Velcro® or a zipper, for example. The plurality of sections 114,116,118 include: a top section 114 which forms a head 146, shoulders 148, and/or arms 150 (FIGS. 2-3) of the animate object; and a pair of side sections 116,118 which form a side 152 and legs 154,156 of the animate object. The top section 114 and side sections 116,118 are removably attached with the hook and loop fasteners 126 adjacent to a respective arm-pit juncture 120,122 of the animate object. Additionally, the respective side sections 116,118 are removably attached with the hook and loop fasteners 126 adjacent to a heel juncture 124 of the legs 154,156 of the animate object. Although FIG. 1 illustrates the junctures 120,122,124 being positioned adjacent to the armpit and heel regions of the animate object, the junctures may be positioned at any region of the animate object, and more or less than three junctures and sections may be employed, depending on the particular design. In an additional exemplary embodiment, the arms 150 may be removably attached to the top section 114, with hook and loop fasteners, such as Velcro® or a zipper, for example. Although the illustrated embodiments of the present invention in FIGS. 1-10 depict the frame 110 as a plurality of sections 114,116,118 which are removably attached, the frame may be formed from a one-piece section, and which is formed from the same plush material, for example.

In an exemplary embodiment of the present invention, the pair of side sections 116,118 extend along a respective pair of opposing side surfaces 130,132 (See FIG. 1, 3) of the mattress 106 and the boxspring 108. Since FIG. 1 is an exploded view, it illustrates side sections 116,118 being separated from the opposing surfaces 130,132, to illustrate these components. However, as discussed below, during operation of the frame 110, the side sections 116,118 are securably engaged to the opposing side surfaces 130,132. The pair of side sections 116,118 includes a respective vertical bumper 134,136 to extend from a top portion 138 (FIG. 6) of the side sections 116,118 by a predetermined height. The predetermined height of the vertical bumper 134,136 is established to prevent the child on the bed 102 from passing outside the side surfaces 130,132 of the mattress 106 and falling from the mattress 106. As discussed above, the bed 102 and frame 110 may be utilized as a "transition bed" for a child/toddler as they transition from a crib bed to a full-sized bed. The bed 102 and frame 110 may be utilized during this transition period, as the vertical bumpers 134,136 enhance the safety conditions of the child sleeping in the bed 102. Additionally, even after the child matures to being capable of sleeping in a full-sized bed, the child can remain in the bed 102 and frame 110, as the vertical bumpers 134,136 may be removed, as discussed below.

Figures 2, 3:
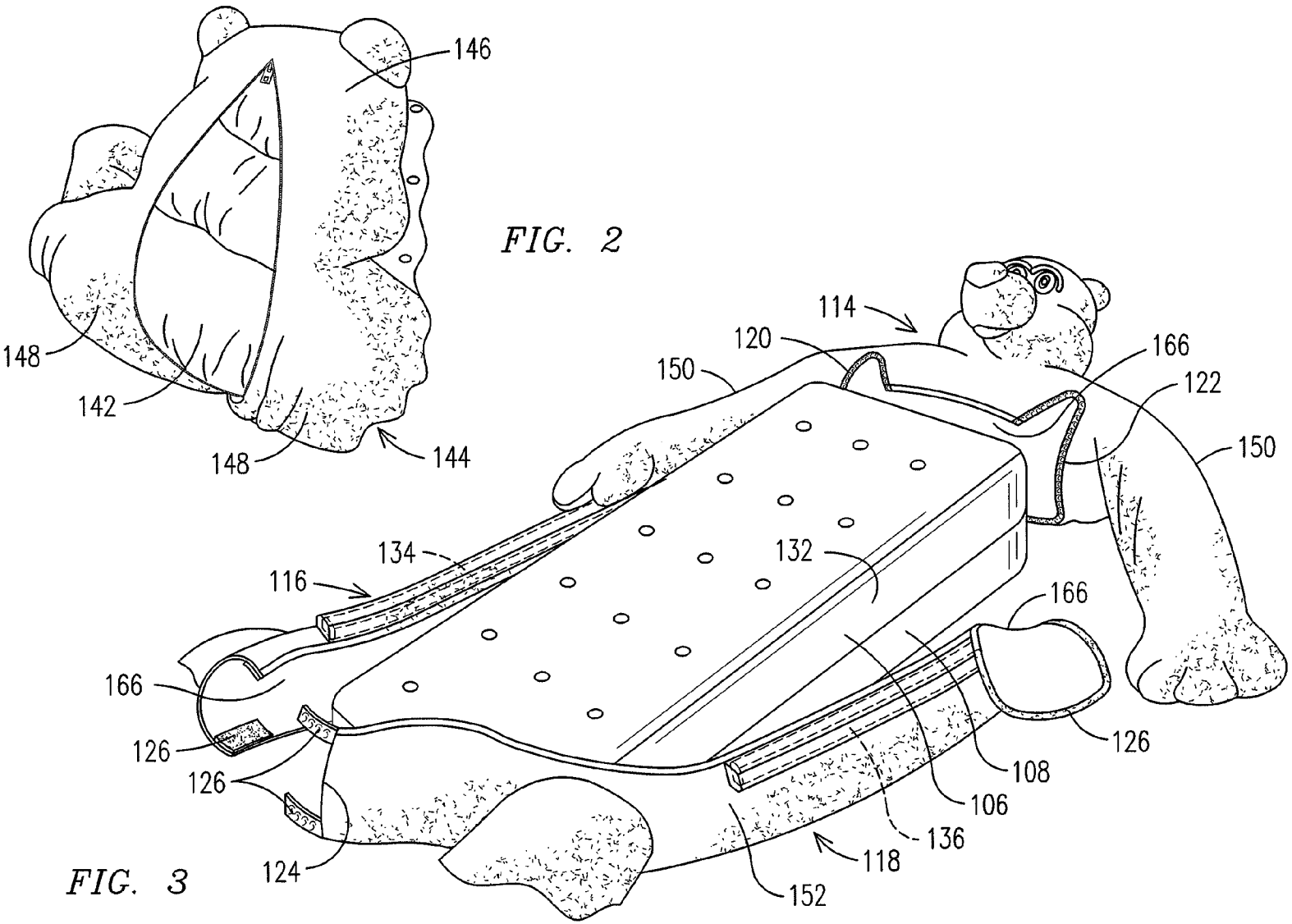
FIG. 2 depicts a partial rear perspective view of an interior of a frame within the system illustrated in FIG. 1.
FIG. 3 depicts a side exploded view of a plurality of sections and a mattress and boxspring of the system illustrated in FIG. 1.

As illustrated in the exemplary embodiment of FIG. 2, a rear view of the head 146 of the top section 114 of the frame 110 depicts the outer surface of the top section 114 with an opening to reveal that an interior of the frame 110 is filled with a foam and/or cushion material 142, such as polyfill, for example. Such foam and/or cushion material 142 which fills the frame 110 is easily removable and washable/replaceable, so as to simplify the maintenance of the frame 110. Although FIG. 2 illustrates the top section 114 and, more specifically, the head 146 of the animate object being opened to reveal the interior cushion material, the interior of each section of the frame 110 may include a similar access point to the interior, to permit the interior cushion material to be removed and/or washed.

Figure 9:
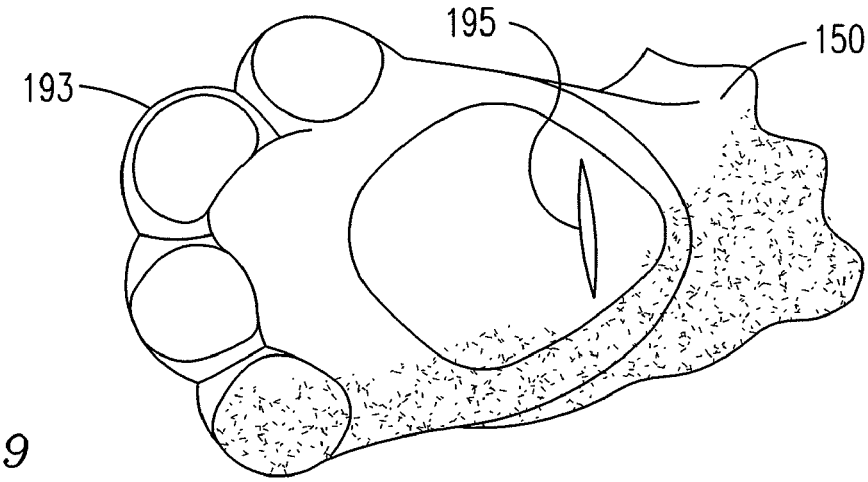
FIG. 9 depicts a partial perspective view of a hand portion of the frame illustrated in FIG. 1, with a slot formed within the hand portion to receive a hand of a child positioned on the bed.

As illustrated in the exemplary embodiment of FIG. 9, the arm 150 of the animate object may end at a paw/hand 193, which includes a slot 195 configured to receive a hand of the child who sleeps on the bed 102. Upon receiving the hand of the child in the slot 195, the arms 150 of the animate object may be maneuvered, so as to embrace the child, as the child crosses their arms, for example. In an exemplary embodiment, an institution which houses children, such as a pediatric hospital or a child care center, may utilize the frame 110 for therapeutic purposes and/or to soothe the child and/or motivate the child to sleep, for example.

Figure 4:
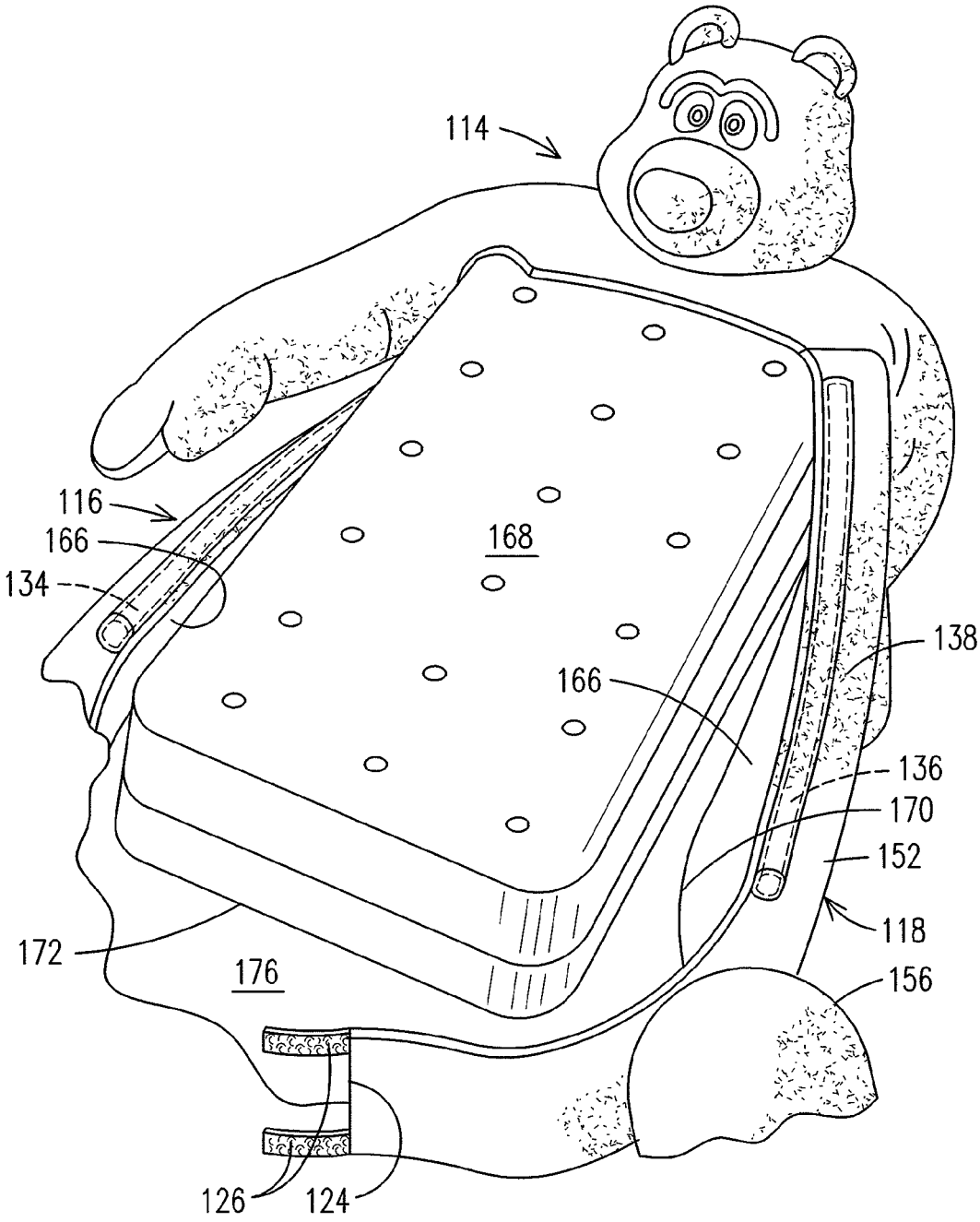
FIG. 4 depicts a front exploded view of the plurality of sections and a mattress and boxspring of the system illustrated in FIG. 1.
Figure 6:
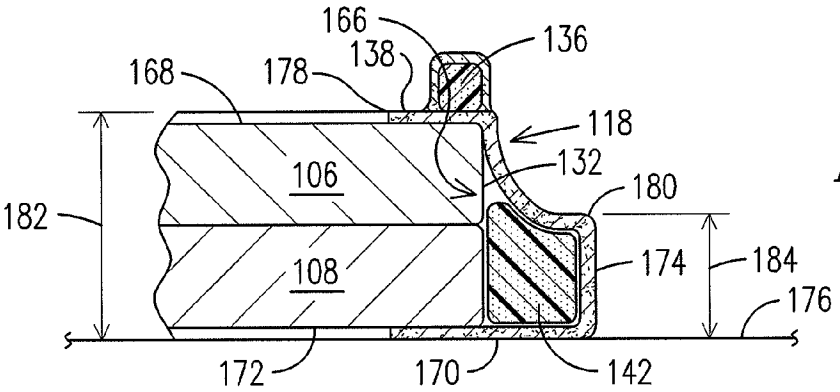
FIG. 6 depicts a side cross-sectional view of the plurality of sections and mattress and boxspring of the system illustrated in FIG. 4.
Figure 5:
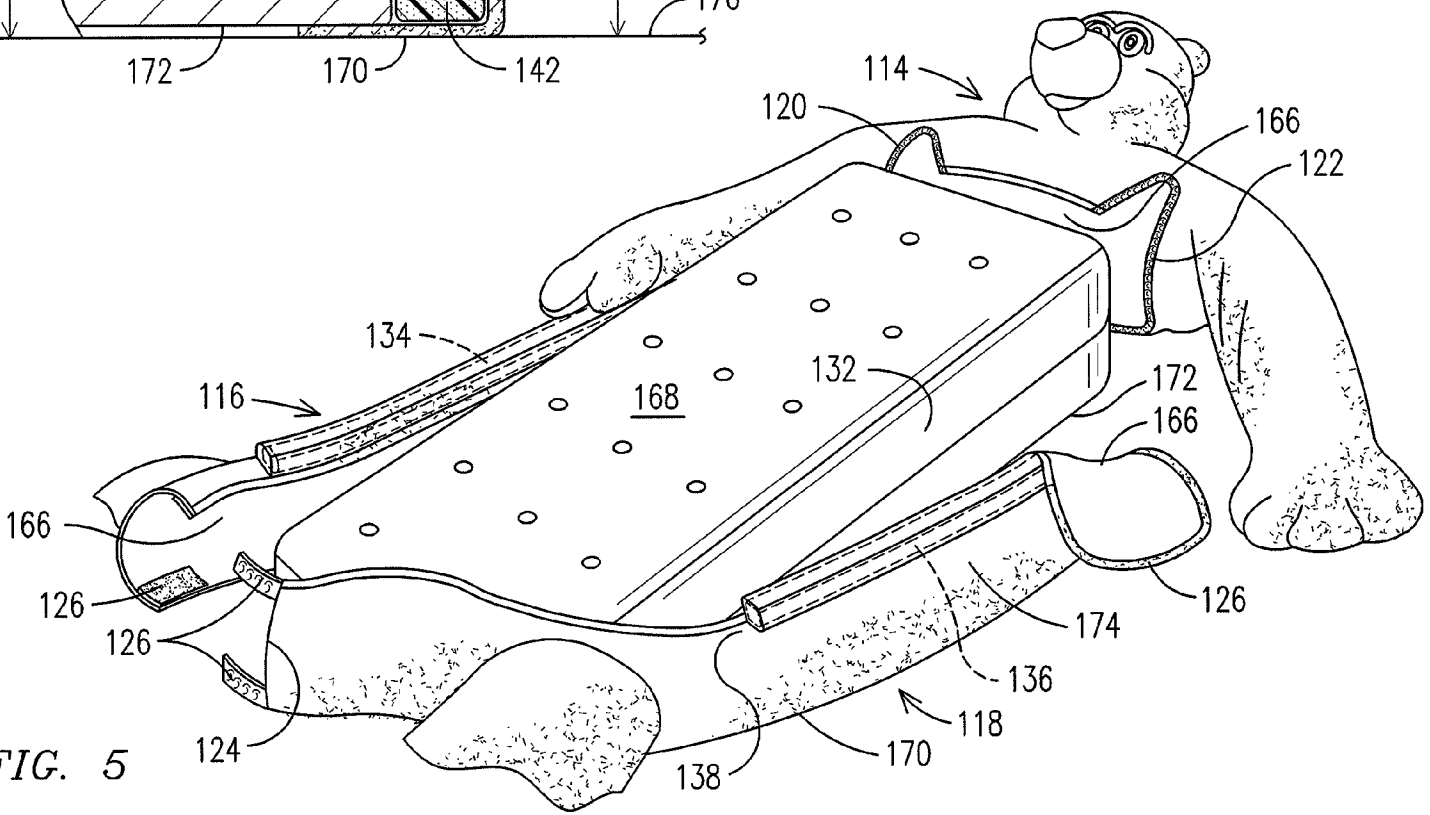
FIG. 5 depicts a front exploded view of the plurality of sections and a mattress and boxspring of the system illustrated in FIG. 1.

As illustrated in the exemplary embodiment of FIG. 4, the plurality of sections 114,116,118 are respectively dimensioned such that a portion of the mattress 106 and boxspring 108 are received within a cavity 166 of the respective sections 114,116,118. Although FIG. 3 illustrates the mattress 106 and boxspring 108 being received within the cavity 166 of the side section 118, the mattress 106 and boxspring 108 are received within an equivalent cavity 166 of the sections 114,116. As illustrated in FIGS. 5-6, the cavity 166 is defined by the top portion 138 of the section 118 extending along a portion of a top surface 168 of the mattress 106. Additionally, the cavity 166 is defined by a base portion 170 of the section 118 extending along a portion of a base surface 172 of the boxspring 108. Additionally, the cavity 166 is defined by a vertical portion 174 of the section 118 which links the base portion 170 and top portion 138, and extends along the side surface 132 of the mattress 106 and boxspring 108, when the mattress 106 and boxspring 108 are received within the cavity 166.

As illustrated in the exemplary embodiment of FIG. 4, the frame 110 is positioned on a floor 176 of a room. However, the frame 110 need not be positioned directly on the floor 176 of the room. Additionally, as illustrated in the exemplary embodiment of FIG. 6, the top portion 138 of the side section 118 includes an inner and outer edge 178,180 having a respective inner and outer height 182,184 relative to the floor 176. The inner and outer edge 178,180 are separated by the vertical bumper 136. Additionally, the inner height 182 corresponds with a height at which a child sleeps on the bed 102, while the outer height 184 corresponds with a height after which a child has passed over the vertical bumper 136, prior to falling to the floor 176. As illustrated in the exemplary embodiment of FIG. 6, the outer height 184 is less than the inner height 182. In an exemplary embodiment, the inner height is in the range of 12-18 inches (30.48-45.72 centimeters), and the outer height is in the respective range of 9-11 inches (22.86-27.94 centimeters). Additionally, in an exemplary embodiment, the vertical bumper may be approximately 4 inches (approximately 10.16 centimeters) in height (relative to the top portion 138), approximately 4 inches (approximately 10.16 centimeters) in width, and approximately 48 inches (approximately 121.9 centimeters) in length (along the side section 118).

Figure 7:
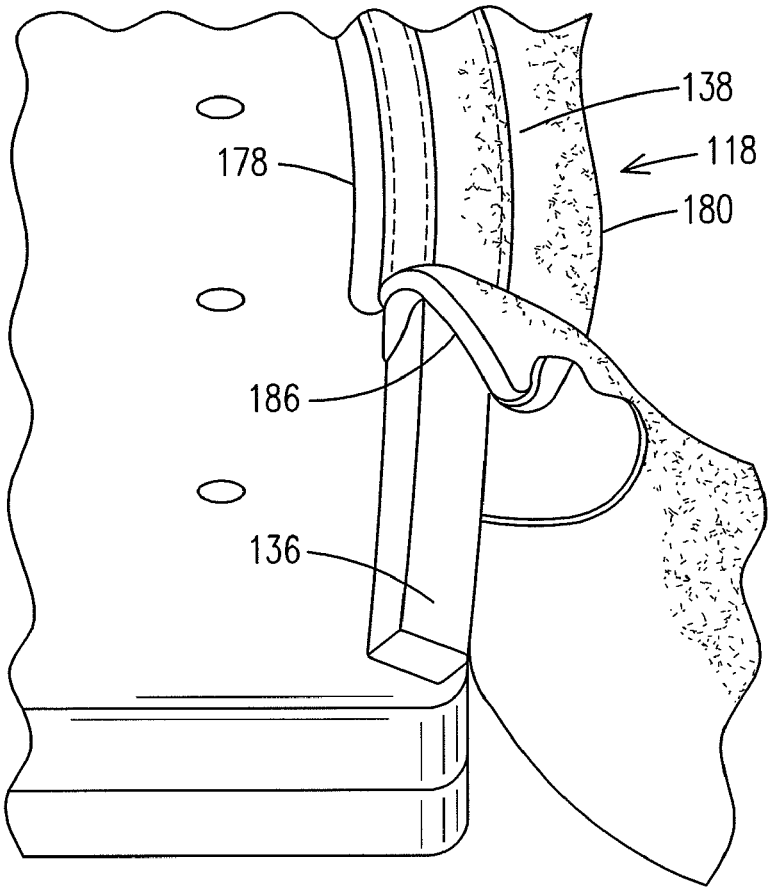
FIG. 7 depicts a partial top perspective view of a removable bumper inserted within a slot of a section of the system illustrated in FIG. 4.

As illustrated in the exemplary embodiment of FIG. 7, a respective slot 186 is formed within the top portion 138 of the side section 118. The respective slot 186 is formed in a direction along the side section 118. Additionally, the vertical bumper 136 is to be removably inserted within the slot 186. Although FIG. 7 illustrates the slot 186 formed within the top portion 138 of the side section 118, an equivalent slot is formed in the top portion of the side section 116, and the vertical bumper 134 is removably inserted within that slot. Although FIG. 7 illustrates that the vertical bumper is removably insertable within the slot, in an exemplary embodiment, the vertical bumper may be directly attached to the top portion 138, using Velcro® or a zipper, for example and, thus, no slot would be needed. In an exemplary embodiment, the respective vertical bumpers 134,136 are formed from a high-density foam material, and are washable, such that they may be easily washed and replaced upon being removed from their respective slots. As with the removably insertable bumper 136 positioned within the slot 186, a removable insert may be positioned within a slot (not shown) adjacent the rear of the head 146 of the animate object, to provide additional neck support, for example. In an exemplary embodiment, such a slot adjacent the rear of the head 146 may encircle the perimeter of the neck, and the removable insert may be sized such that it provides additional support to the neck and/or head of the animate object, when inserted within the slot, for example.

Figure 8:
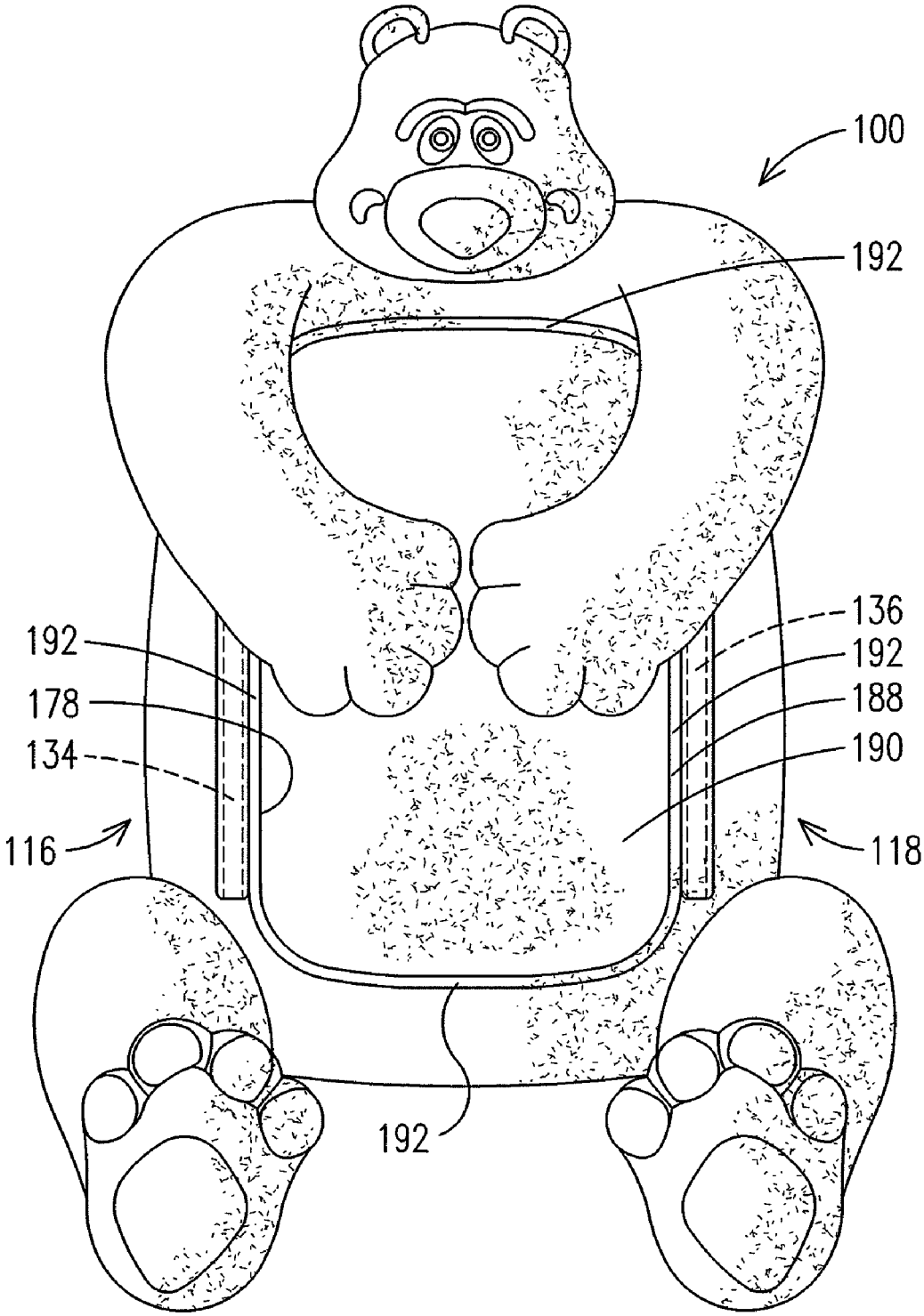
FIG. 8 depicts a top plan view of the system illustrated in FIG. 1, with a blanket covering the mattress.

As illustrated in the exemplary embodiment of FIG. 8, the inner edge 178 of the side sections 116,118 includes an integrated elastic fabric 188 to maintain the respective vertical bumpers 134,136 in an upright orientation relative to the top portion 138 of the side sections 116,118. The integrated elastic fabric 188 may be sewn and/or weaved into the plush material fabric of the inner edge 178 of the side sections 116,118, for example. The elastic fabric 188 maintains an inward compression from the side sections 116,118 on the opposing side surfaces 130,132 of the mattress 106 and the boxspring 108, such that the frame 110 maintains an upright orientation, relative to the mattress 106 and boxspring 108. Additionally, as illustrated in the exemplary embodiment of FIG. 8, the system 100 includes a bed sheet 190 to cover the mattress 106, and a perimeter of the bed sheet 190 includes hook and loop fasteners 192, such as Velcro® or a zipper, for example. Upon placement of the bed sheet 190 on the mattress 106, the hook-and-loop fasteners 192 of the bed sheet 190 perimeter secure to a plurality of hook-and-loop fasteners 192 positioned along the inner edge 178 of the side sections. Thus, the bed sheet 190 is positioned on the mattress 106, to provide further support in maintaining the side sections 116, 118 and frame 110 in an upright orientation, for example.

Figure 10:
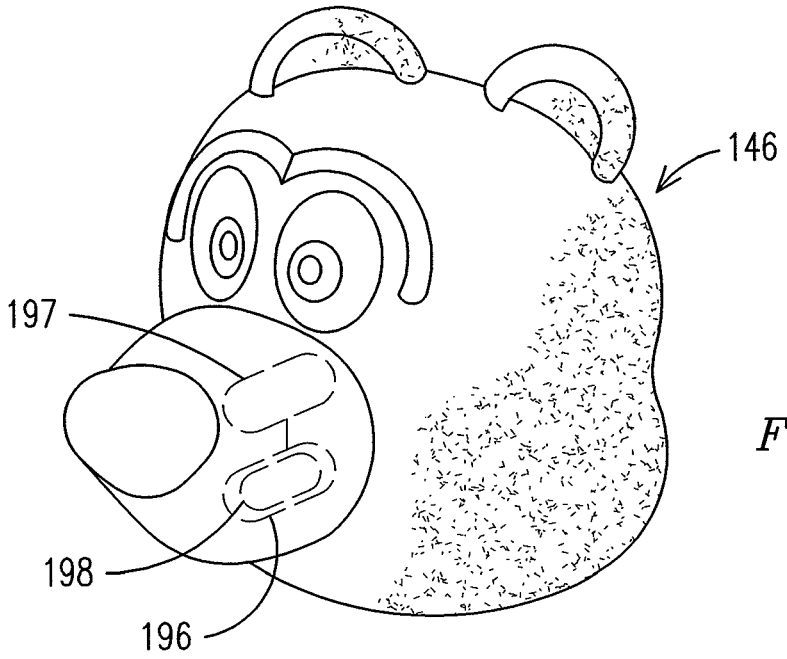
FIG. 10 depicts a partial perspective view of a head portion of the frame illustrated in FIG. 1, with a cavity formed within the head portion to receive an audio output device.

As illustrated in the exemplary embodiment of FIG. 10, a cavity 196 is formed within the head 146 of the top section 114 of the frame 110. The cavity 196 is formed and sized to receive an audio output device 198 to transmit an audio signal capable of being heard by the child in the bed 102. The audio output device 198 is coupled to a power source and an audio input device 197, such that the audio input device 197 detects an audible input, such as a child's voice, and the audio output device 198 initiates transmission of the audio signal, based on the detection of the audible input by the audio input device 197. In an exemplary embodiment, the audio output device may be a speaker, CD player, MP3 player, and/or any audio output device known to one of skill in the art which is capable of outputting an audio signal, based on an input signal. In an exemplary embodiment, the audio input device may be a microphone, or similar device, to detect the child's voice, and may be configured to distinguish whether the child is requesting a particular audio signal, such as a particular audio track/bed-time story, which is stored in a memory connected to the audio output device. The audio output device may be configured to receive a signal from the audio input device, which indicates a desired audio track/bed-time story, and subsequently outputs the desired audio track/bed-time story. Although FIG. 10 illustrates the audio input/output device 197,198 being positioned with the head 146 of the animate object, the audio input/output devices 197,198 may be positioned at any location within the animate object.

Figure 11:
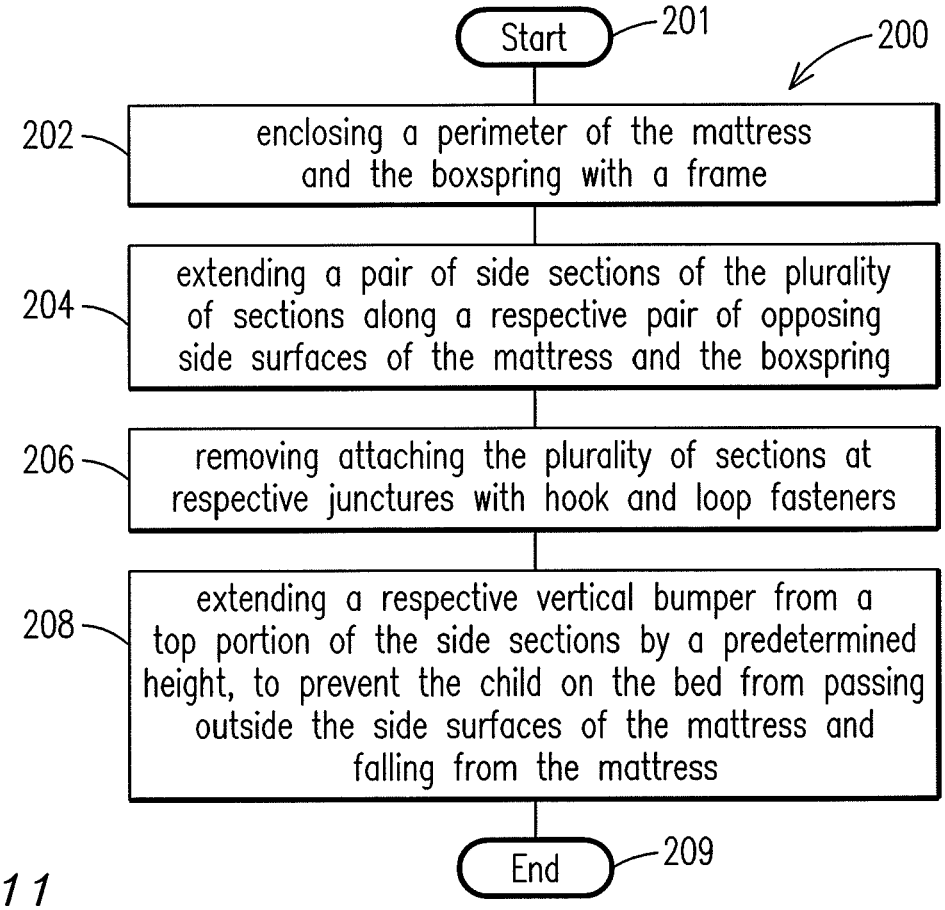
FIG. 11 depicts a flowchart illustrating an exemplary embodiment of a method for enhancing the safety of a sleeping arrangement for a child on a bed in accordance with the present invention.

FIG. 11 illustrates a flowchart depicting an exemplary embodiment of a method 200 for enhancing the safety of a sleeping arrangement for a child on a bed 102. The method 200 begins at 201 by enclosing 202 a perimeter of the mattress 106 and the boxspring 108 with a frame 110. The frame 110 includes a plurality of sections 114,116,118, and has an outer surface 128 formed from a plush material. The enclosing 202 step includes extending 204 a pair of side sections 116,118 of the plurality of sections along a respective pair of opposing side surfaces 130,132 of the mattress 106 and the boxspring 108. The enclosing 202 step also includes removably attaching 206 the plurality of sections 114,116,118 at respective junctures 120,122,124 with hook and loop fasteners 126. The method 200 further includes extending 208 a respective vertical bumper 134,136 from a top portion 138 of the side sections 116,118 by a predetermined height, to prevent the child on the bed 102 from passing outside the side surfaces 130,132 of the mattress 106 and falling from the mattress 106.

FIGS. 12-17 illustrate an embodiment of the present invention, which is a variation of the previously-discussed embodiments, in which a cover sheet is introduced. As discussed in greater detail below, the cover sheet is secured to the bed frame, such that it covers the top surface of a mattress. Additionally, as discussed in greater detail below, the cover sheet may support safety bumpers along the sides of the mattress, to prevent a child from falling from the mattress and the bed frame. The embodiments of the present invention provides several advantageous features, such as a readily detachable cover sheet from the bed frame, to reduce the effort needed to remove and wash the cover sheet. Additionally, the cover sheet is configured such that it is attachable to a flexible or textile bed frame. Additionally, the cover sheet is described in several embodiments in which the bumpers are supported by the cover sheet, to provide flexibility for the manufacturer and/or the consumer, when deciding on an optimal cover sheet arrangement.

Figure 12:
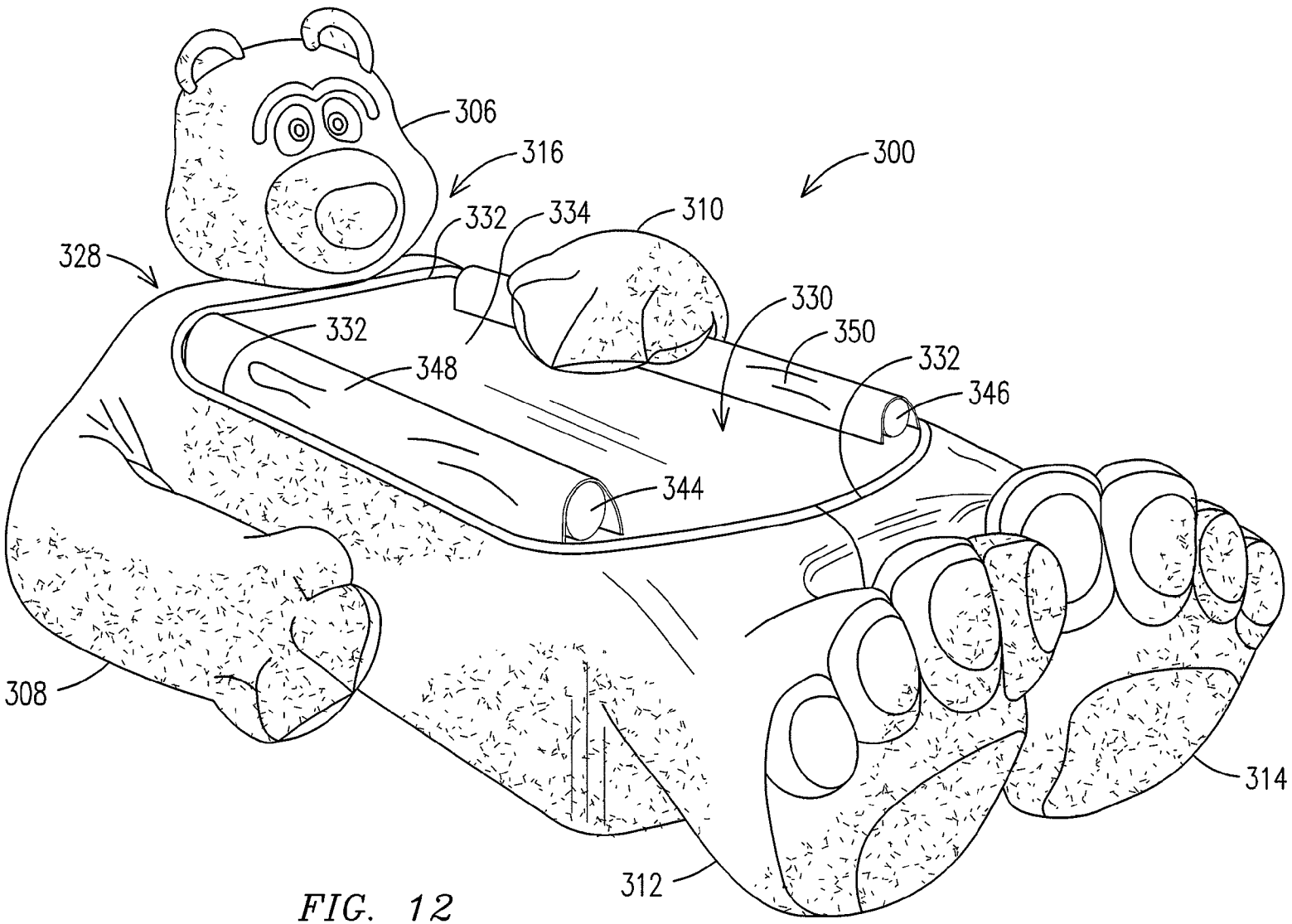
FIG. 12 depicts a side perspective view of a flexible system for surrounding a perimeter and covering a top surface of a mattress, in accordance with the present invention.
Figure 13:
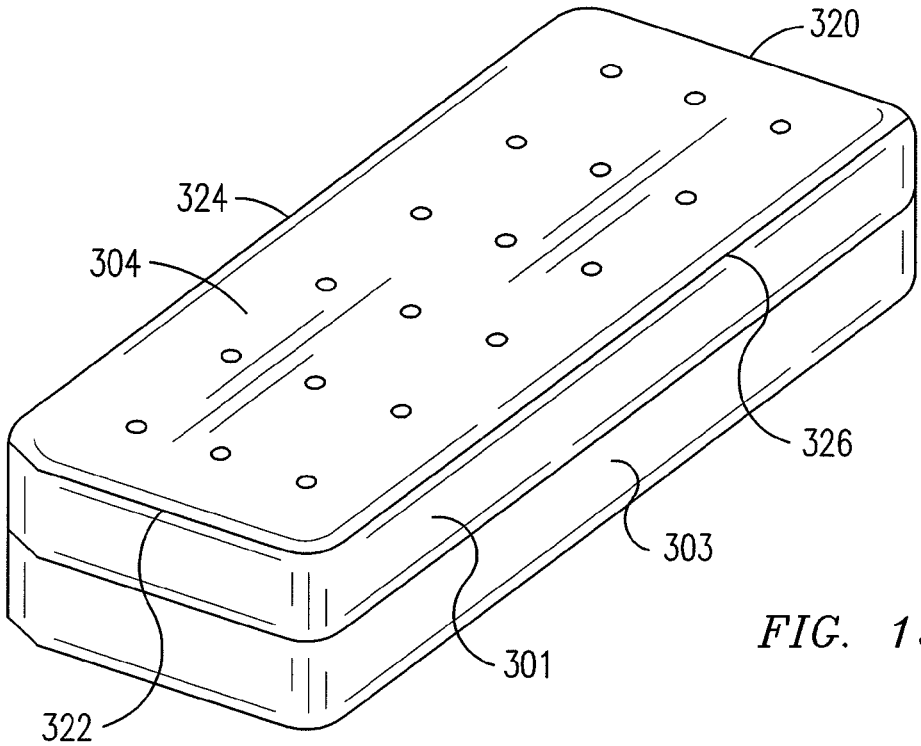
FIG. 13 depicts an exploded view of the mattress over which the cover sheet is to be positioned, in accordance with the present invention.

As illustrated in FIGS. 12 and 13, a flexible system 300 is provided for surrounding a perimeter of a mattress 301, and covering a top surface 304 of the mattress 301. Additionally, the flexible system 300 may surround the perimeter of the mattress 301 and an accompanying boxspring 303, but the embodiments of the present invention need not include the boxspring 303. The flexible system 300 may support one or more appendages of a character 316, such as an animate character. However, the flexible system 300 is not limited to this arrangement and may feature a frame which does not support one or more appendages of a character. Although FIG. 12 illustrates a bear character, with a head 306, a pair of arms 308,310, and a pair of feet 312,314, the present invention is not limited to the bear character, and includes any character (animate or inanimate) which has one or more appendages, such as the head 306, arms 308,310 and feet 312,314 of the bear character, for example. For example, the embodiment of the present invention may support one or more appendages of a shark character, including a head, a pair of side fins and a tail fin, or a dog character, including a head, a pair of front legs and a pair of back legs, for example.

Figure 14:
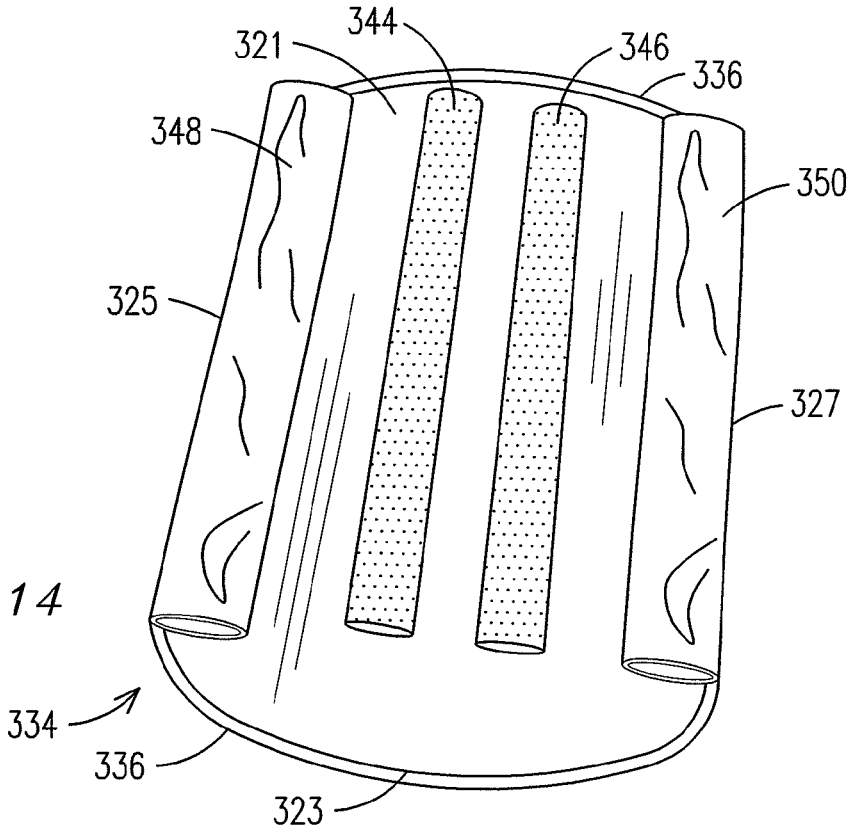
FIG. 14 depicts a top view of a cover sheet, of the system of FIG. 12, to be positioned over a top surface of a mattress, in accordance with the present invention.

As illustrated in FIG. 13, the mattress 301 has four sides including a head side 320, a foot side 322 and intermediate parallel sides 324,326 which extend between the head and foot sides 320,322. The mattress 301 may be a standard-sized mattress, such as a single, twin, queen or king, or may be a custom-sized mattress. As discussed below, the system 300 may be formed by attaching one or more sections to one another, which forms an opening in which the mattress 301 is received/positioned. As illustrated in FIG. 14, a cover sheet 334 is provided, which is positioned to cover the top surface 304 of the mattress 301. The cover sheet 334 has four sides, including a head side 321, a foot side 323 and intermediate parallel sides 325,327, which are respectively aligned with the head side 320, foot side 322, and intermediate parallel sides 324,326 of the mattress 301, after the cover sheet 334 is positioned over the top surface 304 of the mattress 301, and the system 300 is assembled (FIG. 12). However, the cover sheet 334 is not limited to the arrangement of four sides discussed above, and may take a circular, an oval or an irregular shape, for example. Since the mattress 301 is either standard-sized (i.e., single, twin, queen, king) or custom-sized, the cover sheet 334 is similarly standard-sized or custom-sized, to accommodate the respective mattress 301. For example, a queen-sized cover sheet may be manufactured, to fit all queen-sized mattresses, for example.

As illustrated in FIG. 12, the flexible system 300 includes a textile or fabric frame 328 which includes an opening 330 to receive the mattress 301 (FIG. 13). The textile or fabric frame may be formed from a plush material, such as a plush material which is removable, washable, and conforms to ASTM standards, for example. As discussed above, the mattress 301 may be a standard-sized mattress or a custom-sized mattress and, thus, the textile or fabric frame 328 may be correspondingly sized, to receive the standard-sized mattress (e.g., a twin-sized and queen-sized frame, etc.) or to receive the custom-sized mattress. As discussed below, the textile or fabric frame 328 includes one or more sections, similar to the frame 110 illustrated in FIG. 3, and the one or more sections are attached to one another, with flexible textile fasteners, such as hook and loop fasteners or a zipper, to form the opening 330. Although the mattress 301 is not visible in FIG. 12, the one or more sections of the textile or fabric frame 328 are wrapped around the mattress 301, to form the opening 330, such that the mattress 301 is positioned within the opening 330 of textile or fabric frame 328, underneath the cover sheet 334. After the mattress 301 has been received and positioned within the opening 330, the textile or fabric frame 328 covers portions of the head side 320, the foot side 322 and the intermediate sides 324,326 of the mattress 301. The sections of the textile or fabric frame 328 may be removably fastened either prior to or subsequent to the positioning of the mattress 301 within the opening 330 of the textile or fabric frame 328. The sections of the textile or fabric frame 328 have a similar structure and attachment arrangement as the frame 110 discussed in the previous embodiment. The opening within the textile or fabric frame may be circular, oval, rectangular or take any shape/form, provided that the cover sheet and the textile or fabric frame are capable of being secured together, as discussed below.

As further illustrated in FIGS. 12 and 15-17, the opening 330 has an inner peripheral edge 332, along which one or more flexible textile fasteners may be placed, such as hook and loop fasteners, or a zipper, for example. FIG. 14 illustrates the cover sheet 334, which is positioned over the top surface 304 of the mattress 301, after the mattress 301 has been received within the opening 330 of the textile or fabric frame 328. As illustrated in FIG. 14, the cover sheet 334 includes an outer peripheral edge 336, along which one or more flexible textile fasteners may be placed, such as hook and loop fasteners or a zipper, for example. After the cover sheet 334 has been positioned over the top surface 304 of the mattress 301, the outer peripheral edge 336 of the cover sheet 334 is removably attached to the inner peripheral edge 332 of the opening 330 of the frame 328. In an exemplary embodiment, the outer peripheral edge 336 is removably attached to the inner peripheral edge 332 along an attachment segment 352 (FIGS. 15-17), by securing the flexible textile fasteners of the outer peripheral edge 336 to the flexible textile fasteners of the inner peripheral edge 332, such as by securing a zipper along the attachment segment 352, for example. The inner peripheral edge 332 of the opening 330 has a geometric configuration, while the outer peripheral edge 336 of the cover sheet 334 has a matching geometric configuration to the geometric configuration of the inner peripheral edge 332, such that upon removably attaching the inner peripheral edge 332 to the outer peripheral edge 336, the cover sheet 334 is secured to the textile or fabric frame 328.

As previously discussed, the bear character 316 illustrated in FIG. 12, has appendages including a head 306, arms 308, 310, and legs 312,314. The head 306 appendage of the bear character 316 is supported by the textile or fabric frame 328 at or adjacent to the head side 320 of the mattress 301 (after the mattress 301 is positioned within the opening 330 and the system 300 is assembled). Additionally, the arms 308,310 of the bear character 316 are supported by the textile or fabric frame 328 at or adjacent to the parallel sides 324,326 of the mattress 301. Additionally, the legs 312,314 of the bear character 316 are supported by the textile or fabric frame 328 at or adjacent to the foot side 322 of the mattress 301. Although FIG. 12 illustrates an arrangement in which the appendages of the bear character 316 are supported by the frame 328 at or adjacent to specific sides of the mattress, the embodiment of the present invention is not limited to this arrangement, and the appendages of the bear character or any character may be supported by the textile or fabric frame at or adjacent to any side of the mattress.

As illustrated in FIG. 14, the system 300 includes a pair of bumpers 344,346 which have a length approximately equal to the length of the intermediate parallel sides 325,327 of the cover sheet 334 and the intermediate parallel sides 324,326 of the top surface 304 of the mattress 301. The bumpers 344,346 may have a circular cross-sectional form, rectangular cross-sectional form, or any polygon cross-sectional form, provided that the cross-sectional form achieves the desired functional feature of preventing the child from passing outside the intermediate parallel sides 324,326 of the mattress 301, when the child is sleeping in the bed. When the system 300 is assembled, the bumpers 344,346 are positioned on the cover sheet 334, and aligned with the intermediate parallel sides 325,327 of the cover sheet 334 and the intermediate parallel sides 324,326 of the top surface 304 of the mattress 301. The bumpers 344,346 are secured to the cover sheet 334, which in turn is secured to the textile or fabric frame 328, in one of several ways. Although FIG. 14 illustrates two bumpers 344, 346 which are secured along the intermediate parallel sides 324,326 of the mattress 301 (FIG. 12), the embodiment of the present invention is not limited to this arrangement, and more or less than two bumpers may be utilized, such as four bumpers may be secured along the head side 320, foot side 322, and parallel sides 324,326 of the mattress 301, to prevent the child from passing over any side of the mattress 301 during sleep, which may be possible if the child has a tendency to rotate within the bed during sleep.

Figure 15:
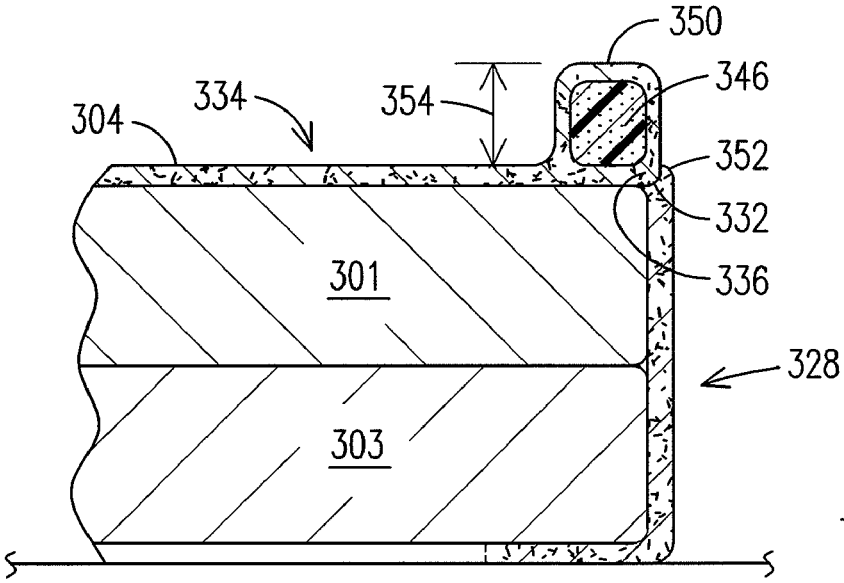
FIG. 15 is a side cross-sectional view of an inner peripheral edge of a frame of the system in FIG. 12 attached to an outer peripheral edge of the cover sheet illustrated in FIG. 13.
Figure 16:
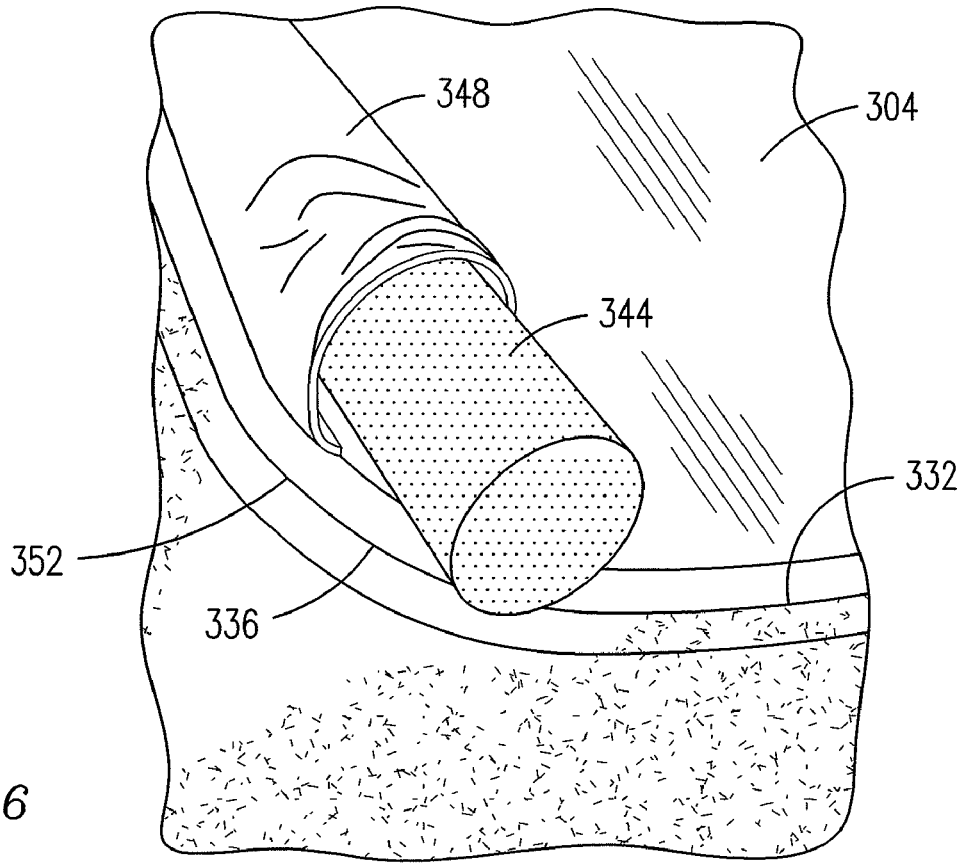
FIG. 16 is a partial perspective view of a bumper positioned within a slot of the cover sheet attached to the inner peripheral edge of the frame of the system illustrated in FIG. 15.
Figure 17:
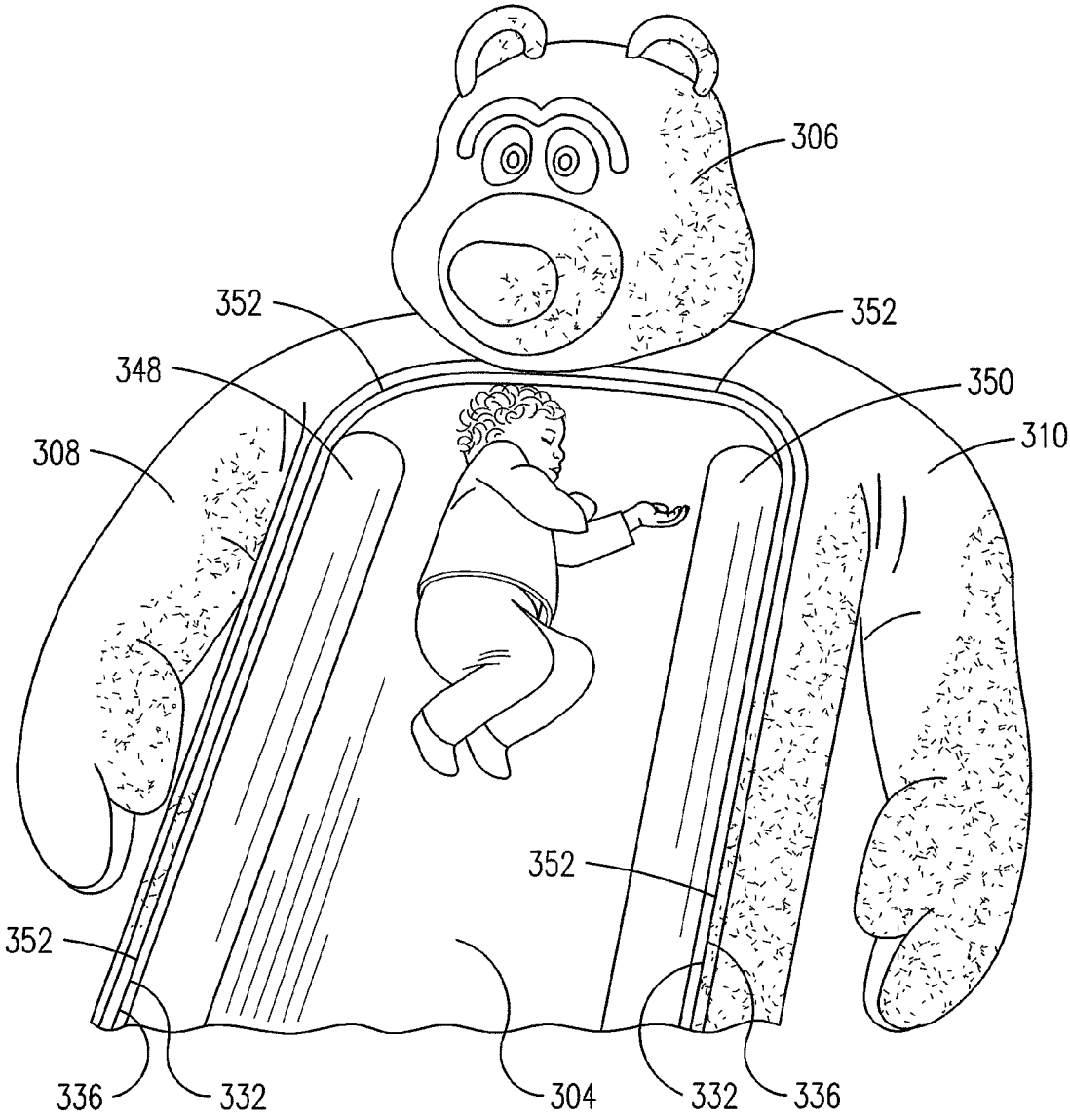
FIG. 17 is a top view of a sleeping child within the system after the inner peripheral edge of the frame has been attached to the outer peripheral edge of the cover sheet, as illustrated in FIG. 15.

FIG. 14 illustrates a pair of sleeves 348,350 attached to the intermediate parallel sides 325,327 of the cover sheet 334 and aligned with the intermediate sides 324,326 of the top surface 304 of the mattress 301 (after the cover sheet 334 is positioned over the top surface 304). In an exemplary embodiment, flexible textile fasteners are attached to the sleeves 348,350 and along the pair of intermediate parallel sides 325,327, such that the pair of sleeves 348,350 are removably attached to the pair of parallel sides 325,327 of the cover sheet 334, by removably securing the flexible textile fasteners of the sleeves 348,350 and the parallel sides 325,327. As discussed above, the flexible textile fasteners may be hook and loop fasteners or a zipper, for example. Upon removably attaching the sleeves 348,350 along the opposing sides 325,327 of the cover sheet 334, the bumpers 344,346 are subsequently removably inserted within the sleeves 348,350 and are thereby oriented along the opposing sides 325,327 of the cover sheet and the opposing sides 324,326 of the mattress 301. The pair of sleeves 348,350 may be attached along the attachment segment 352 (FIGS. 15-17) of the inner peripheral edge 332 of the textile or fabric frame 328 and the outer peripheral edge 336 of the cover sheet 334. As discussed above, the inner peripheral edge 332 may be removably attached to the outer peripheral edge 336, by removably attaching flexible textile fasteners along the respective inner peripheral edge 332 and the outer peripheral edge 336, such as hook and loop fasteners or a zipper, for example. As illustrated in FIGS. 12 and 15-16, the pair of bumpers 344,346 is removably inserted within the pair of sleeves 348,350, either prior to or subsequent to positioning the cover sheet 334 over the top surface 304 of the mattress 301. As discussed above, the bumpers 344,346 may take a variety of cross-sectional forms, such as circular, rectangular, or any polygon, for example. Similarly, the sleeves 348,350 may be sized, to have an inner cross-sectional form corresponding to the cross-sectional form of the bumpers 344,346, to enhance the removable insertion of the bumpers 344,346 within the sleeves 348,350, for a more secured fit.

In an exemplary embodiment, the pair of sleeves 348,350 are formed in the fabric of the cover sheet 334, and are aligned with the intermediate sides 325,327 of the cover sheet 334 and the intermediate sides 324,326 of the mattress 301 (after the cover sheet 334 has been positioned over the mattress 301). Thus, the sleeves 348,350 may be sewn into the fabric of the cover sheet 334, either by hand or with an automated device. The embodiment of the present invention is not limited to the sleeves 348,350 being sewn into the fabric of the cover sheet 334, and includes any means for forming/integrating the sleeves 348,350 into the fabric of the cover sheet 334. After the cover sheet 334 has been formed, with the sleeves 348,350 integrated into the fabric of the cover sheet 334, the pair of bumpers 344,346 is removably inserted within the pair of sleeves 348,350, as previously discussed.

As illustrated in FIG. 15, the bumper 346 and the sleeve 350 have a cross-sectional form, in which the sleeve 350 and the bumper 346 include a dimension to extend from the top surface 304 of the mattress 301 by a predetermined height 354. The predetermined height 354 may be selected, based on various safety factors, to ensure that the child remains within the cover sheet 304 between the bumpers 344,346 and does not exceed the predetermined height 354 at the bumpers 344, 346, during sleep. For example, the predetermined height may be larger for a larger frame and/or for an older child/user. Although FIG. 15 illustrates the bumper 346 positioned within the sleeve 350, the bumper 344 positioned within the sleeve 348 has a similar shape or configuration, as appreciated by one of skill in the art.

While the present invention has been described with reference to various exemplary embodiments, it will be understood by those skilled in the art that various changes, omissions and/or additions may be made and equivalents may be substituted for elements thereof without departing from the spirit and scope of the invention. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A flexible system for surrounding a perimeter and covering a top surface of a mattress, the flexible system supporting one or more appendages of a character, the mattress having four sides including a head side, a foot side and intermediate parallel sides extending between the head and foot sides, said flexible system comprising:

a textile or fabric frame for covering portions of each of the head side, the foot side and the intermediate sides of the mattress, said textile or fabric frame forming an opening around at least a portion of a top surface of the mattress, said opening having an inner peripheral edge;

a cover sheet positioned over the top surface of the mattress, the cover sheet having an outer peripheral edge that is removably attached to the inner peripheral edge of the opening of the frame; and the one or more of the appendages of the character being supported on the textile or fabric frame at one or more of the head side, the foot side and the intermediate sides of the mattress.

2. The system of claim 1, wherein the textile or fabric frame comprises a plurality of sections that are removably fastened to one another with flexible textile fasteners.

3. The system of claim 2, wherein said flexible textile fastener is one of a hook and loop fastener or a zipper.

4. The frame and mattress cover of claim 1, further comprising a pair of bumpers disposed on the cover sheet and aligned with the intermediate sides of the mattress, said bumpers being secured to the textile or fabric frame and the cover sheet.

5. The system of claim 4, further comprising a pair of sleeves attached to the cover sheet and aligned with the intermediate sides of the mattress, adjacent the inner peripheral edge of the textile or fabric frame and the outer peripheral edge of the cover sheet, said pair of bumpers being removably inserted within the pair of sleeves.

6. The system of claim 4, further comprising a pair of sleeves formed in the fabric of the cover sheet and aligned with the intermediate sides of the mattress, said sleeves being disposed on the cover sheet; said pair of bumpers being removably inserted within the pair of sleeves.

7. The system of claim 4, wherein the appendage of the character is a head of the character, said textile or fabric frame configured to support the head of the character at the head side of the mattress.

8. The system of claim 4, wherein the appendage of the character is a pair of legs of the character, said textile or fabric frame configured to support the legs of the character at the foot side of the mattress.

9. The system of claim 4, wherein the appendage of the character is a pair of arms of the character, said textile or fabric frame configured to support the arms of the character at the intermediate sides of the mattress.

10. The system of claim 1, wherein the inner peripheral edge of the opening has a geometric configuration and wherein the outer peripheral edge of the cover sheet has a matching geometric configuration to the geometric configuration of the opening, to secure the cover sheet to the textile or fabric frame.

11. A flexible system for surrounding a perimeter and covering a top surface of a mattress, the mattress having four sides including a head side, a foot side and intermediate parallel sides extending between the head and foot sides, said flexible system comprising:

a textile or fabric frame for covering portions of each of the head side, the foot side and intermediate parallel sides of the mattress, said textile or fabric frame forming an opening around at least a portion of a top surface of the mattress, said opening having an inner peripheral edge; and a cover sheet positioned over the top surface of the mattress, the cover sheet having an outer peripheral edge that is removably attached to the inner peripheral edge of the opening of the frame.

12. The flexible system of claim 11, wherein the textile or fabric frame is for covering portions of the head side, the foot side and the intermediate parallel sides of the mattress.

13. The flexible system of claim 11, further comprising a pair of bumpers disposed on the cover sheet and aligned with the intermediate parallel sides of the mattress.

14. The flexible system of claim 11, wherein said flexible system is configured to support one or more appendages of a character, and wherein the one or more of the appendages of the character are supported on the textile or fabric frame at one or more of the head side, the foot side or the intermediate sides of the mattress.

15. The flexible system of claim 14, wherein the appendage of the character is a head of the character, said textile or fabric frame configured to support the head of the character at the head side of the mattress.

* * * * *